US006065763A

United States Patent [19]

Adams, Jr.

[11] Patent Number: 6,065,763

[45] Date of Patent: May 23, 2000

[54] ROLLER BOUNCER AND WAVE BOARD SKATE

[76] Inventor: Raymond L. Adams, Jr., 3762 Lankenan Rd., Philadelphia, Pa. 19131

[21] Appl. No.: 09/017,272

[22] Filed: Feb. 2, 1998

[51] Int. Cl.[7] ..... A63C 17/00

[52] U.S. Cl. ..... 280/11.28; 280/7.1; 280/11.19; 280/11.23

[58] Field of Search ..... 280/7.1, 11.115, 280/11.2, 11.19, 11.22, 11.23, 11.25, 11.27, 11.28, 11.3, 87.042; 16/35 R

[56] References Cited

U.S. PATENT DOCUMENTS

| | | | |
|---|---|---|---|
| 40,093 | 9/1863 | Dutton | 280/11.3 |
| 499,052 | 6/1893 | Storla | 280/11.115 |
| 1,587,749 | 6/1926 | Bierly | 280/11.115 |
| 2,475,092 | 7/1949 | Harrel | 280/11.28 |
| 2,557,331 | 6/1951 | Wintercorn | 280/11.28 |
| 3,219,358 | 11/1965 | Hagner | 280/11.14 |
| 3,988,800 | 11/1976 | Sachser | 16/35 R |
| 4,402,521 | 9/1983 | Mongeon | 280/11.23 |
| 5,127,672 | 7/1992 | Horibata | 280/842 |
| 5,232,071 | 8/1993 | Kawanabe | 188/1.12 |
| 5,347,681 | 9/1994 | Wattron et al. | 16/30 |
| 5,393,077 | 2/1995 | Wanous | 280/7.13 |
| 5,588,734 | 12/1996 | Talamo et al. | 362/61 |
| 5,615,901 | 4/1997 | Piotrowski | 280/7.14 |
| 5,621,984 | 4/1997 | Hsieh | 36/28 |

*Primary Examiner*—J. J. Swann
*Assistant Examiner*—Christopher Bottorff
*Attorney, Agent, or Firm*—Michael I. Kroll

[57] ABSTRACT

A roller bouncer and wave board skate (10) comprising a base plate (12). A plurality of wheel assemblies (14) are disposed on bottom of the base plate (12). A top plate (16) is provided. A structure (18) is for biasing the top plate (16) over the base plate (12). A foot plate (20) supports a shoe (22) of a skater (24). An assemblage (26) is for attaching the foot plate (20) to the top plate (16) in a removable manner, so that the skater (24) will bounce while skating.

20 Claims, 5 Drawing Sheets

14
10
12
44
16
20
50
48
52
24
22
52
10
50
20
16
18
28
12
44
14
1f

ROLLER BOUNCER AND WAVE BOARD SKATE

BACKGROUND OF THE INVENTION

1. Field of the Invention

The instant invention relates generally to roller skates and more specifically it relates to a roller bouncer and wave board skate. The roller bouncer and wave board skate is designed as a totally new and fun skating, skateboarding and exercise experience. It's concept and features are to set up a bouncing and cushioning effect, while using a pair of spring biasing skates with adjustable wheel assemblies.

2. Description of the Prior Art

Numerous roller skates have been provided in prior art that are adapted to be shoes with four small wheels attached to them for skating on sidewalks and hard floors. While these units may be suitable for the particular purpose to which they address, they would not be as suitable for the purposes of the present invention as heretofore described.

SUMMARY OF THE INVENTION

A primary object of the present invention is to provide a roller bouncer and wave board skate that will overcome the shortcomings of the prior art devices.

Another object is to provide a roller bouncer and wave board skate that is designed to be based on a totally new and fun skating, skateboarding and exercise experience, in which its concept and features are to set up a bouncing and cushioning effect, while using a pair of spring biasing skates with adjustable wheel assemblies.

An additional object is to provide a roller bouncer and wave board skate that has the bouncing effect of springs with several spring heights and wheels that allow forward skating and three hundred and sixty degree turns, with a special switchable locking mechanism on the base of each wheel assembly.

A still additional object is to provide a roller bouncer and wave board skate, in which a pair of the skates are also designed to be worn as attachments to sneakers or shoes, hence there is no need to take off athletic footwear in order to enjoy using the skates.

A further object is to provide a roller bouncer and wave board skate that is simple and easy to use.

A still further object is to provide a roller bouncer and wave board skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a first embodiment of the present invention attached to a shoe of a skater.

FIG. 1*a* is a side view of the first embodiment per se, taken in the direction of arrow 1*a* in FIG. 1.

FIG. 1*b* is a cross sectional view taken along line 1*b*—1*b* in FIG. 1*a*.

FIG. 1*c* is a side view similar to FIG. 1*a*, showing a different configuration for the biasing springs.

FIG. 1*d* is a perspective view of a second embodiment of the present invention.

FIG. 1*e* is a front view of the first embodiment showing a different combination for the biasing springs and wheel assemblies, with the shoe of the skater in phantom.

FIG. 1*f* is a bottom view taken in the direction of arrow 1*f* in FIG. 1*e*.

Similar reference characters denote corresponding features consistently throughout the attached drawings.

DESCRIPTION OF THE PREFERRED EMBODIMENTS

Figure 1:
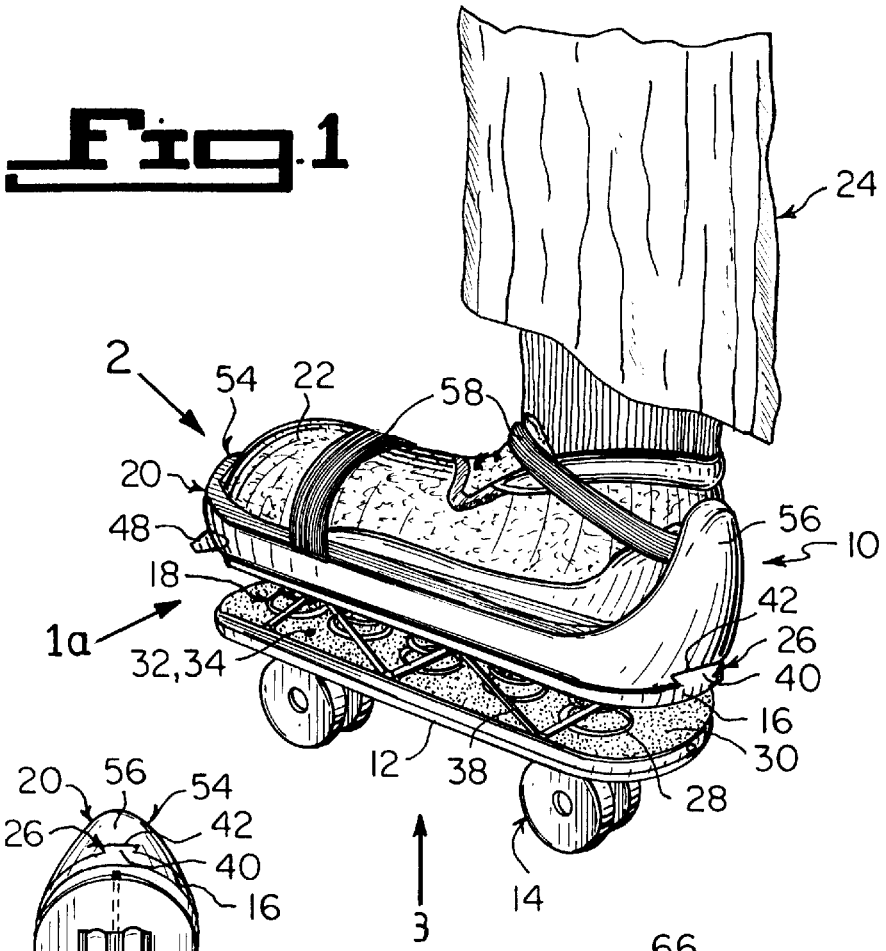
Figure 3:
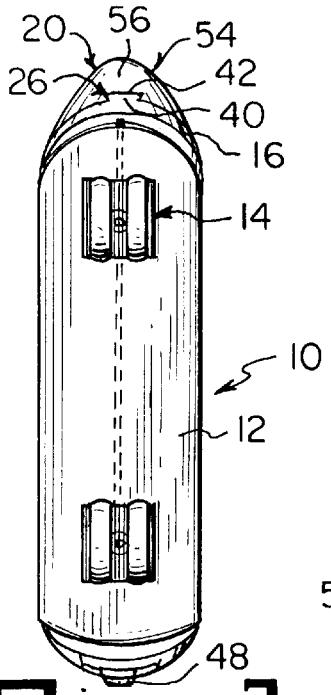
FIG. 3 is a bottom view taken in the direction of arrow 3 in FIG. 1.

Turning now descriptively to the drawings, in which similar reference characters denote similar elements throughout the several views, FIGS. 1 through 5 illustrate the present invention being a roller bouncer and wave board skate 10. With regard to the reference numerals used, the following numbering is used throughout the various drawing figures.

10 roller bouncer and wave board skate
12 base plate of 10
14 wheel assembly of 10
16 top plate of 10
18 biasing structure of 10
20 foot plate of 10
22 shoe of 24
24 skater
26 removable attaching assemblage of 10
28 spring of 18
30 flat padding member of 18
32 foam rubber material for 30
34 durable plastic material for 30
36 cup socket of 18
38 rubber band of 18
40 tongue of 26 in 16
42 groove of 26 in 20
44 ball bearing race of 14
46 locking button mechanism of 14
48 brake pad bumper on 20
50 skateboard deck for 20
52 raised tip on 50
54 roller skate sole for 20
56 raised heel cap on 54
58 strap on 54
60 retaining facility on 58
62 fastener for 60
64 VELCRO tab of 62
66 button snap of 62
68 quick release buckle of 62

The roller bouncer and wave board skate 10 comprises a base plate 12. A plurality of wheel assemblies 14 are disposed on the bottom of the base plate 12. A top plate 16 is provided. A structure 18 is for biasing the top plate 16 over the base plate 12. A food plate 20 supports a shoe 22 of a skater 24. An assemblage 26 is for attaching the foot plate 20 to the top plate 16 in a removable manner, so that the skater 24 will bounce while skating.

The biasing structure 18 includes a plurality of springs 28 spaced apart, retained and extending between the base plate 12 and the top plate 16. Each spring 28 can be a helical compression spring, as shown in FIGS. 1, 1*a*, 1*b*, 1*d* and 1*e*. Each spring 28 can also be an inverted conical compression spring, as shown in FIG. 16.

Figure 2:
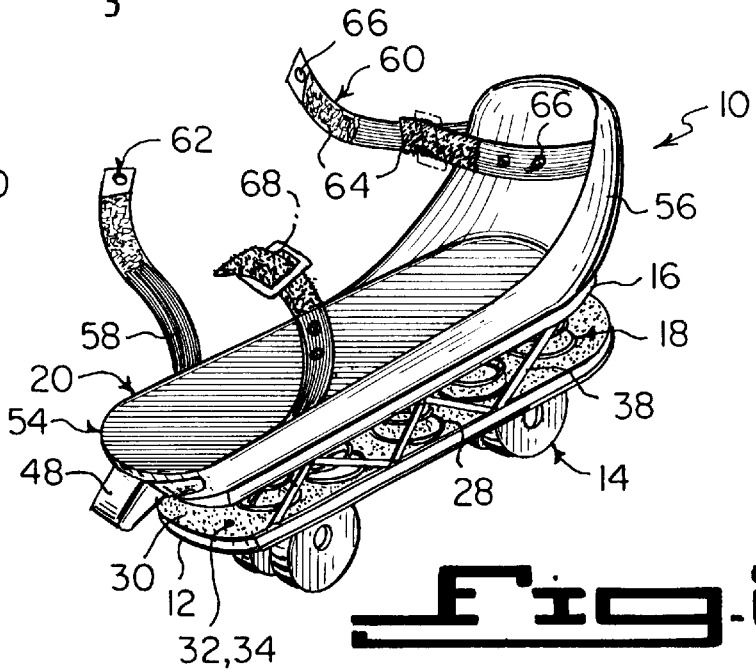
FIG. 2 is a perspective view of the first embodiment per se taken in the direction of arrow 2 in FIG. 1.

The biasing structure 18, as shown in FIGS. 1 and 2, can include a flat padding member 30 placed between the base plate 12 and the springs 28. The flat padding member 30 can be fabricated out of a foam rubber material 32. The flat padding member 30 can also be fabricated out of a durable plastic material 34.

Figure 1A:
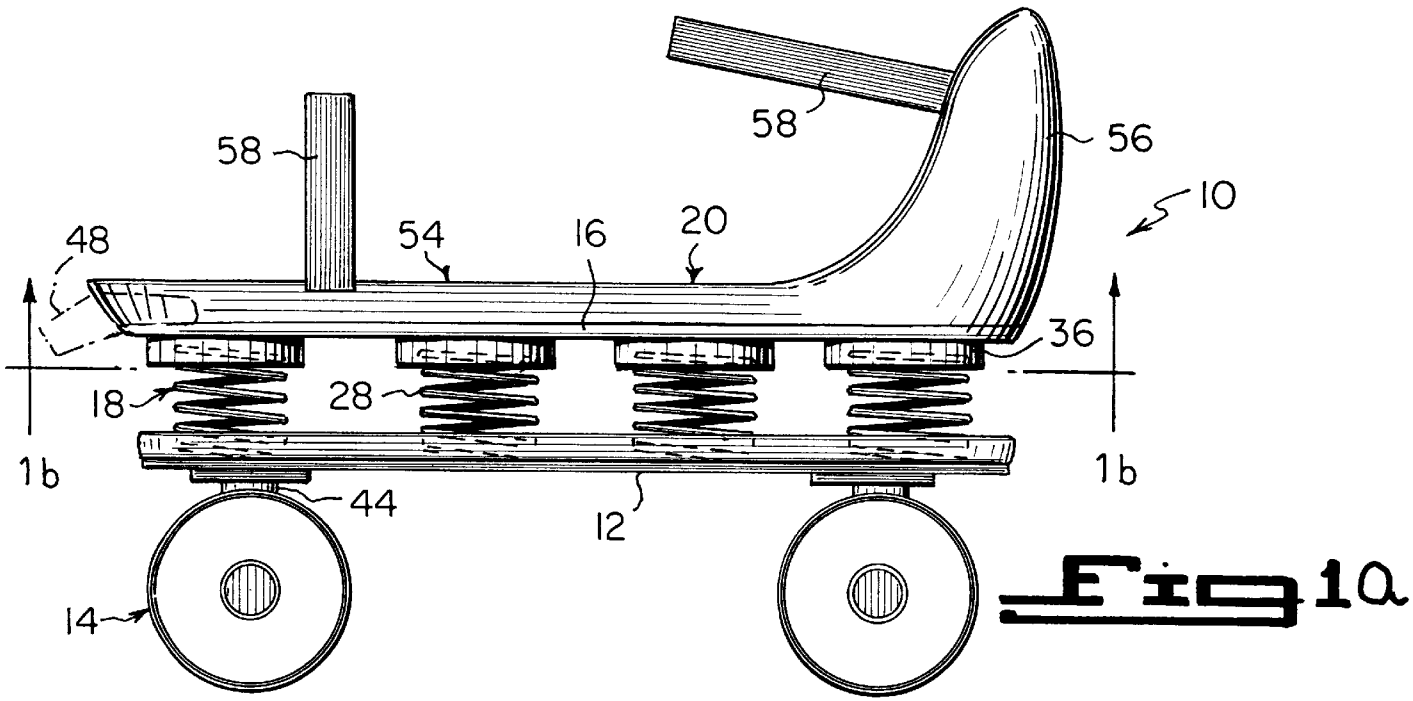
Figure 1B:
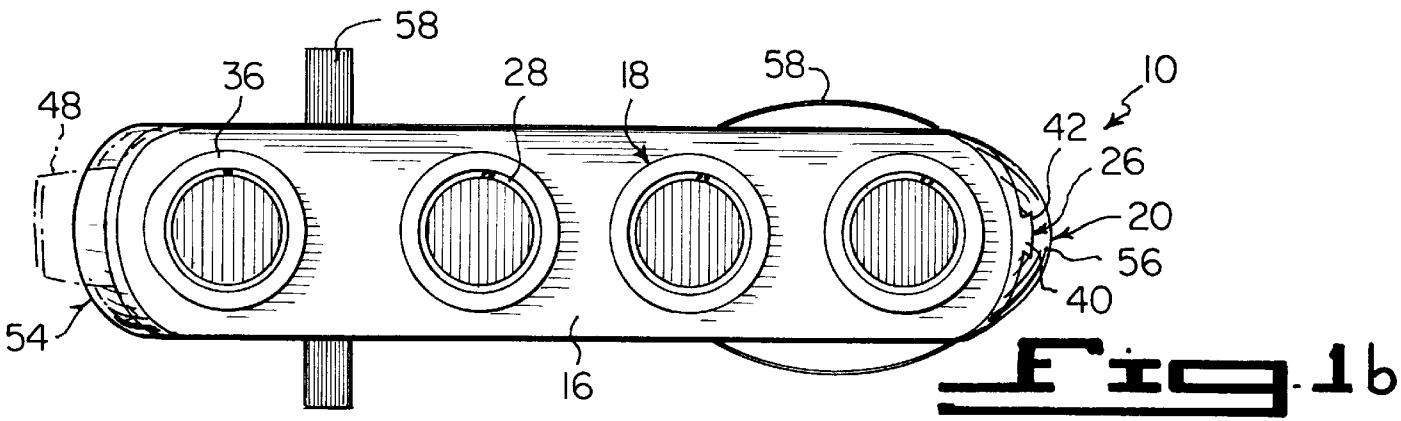
Figure 1C:
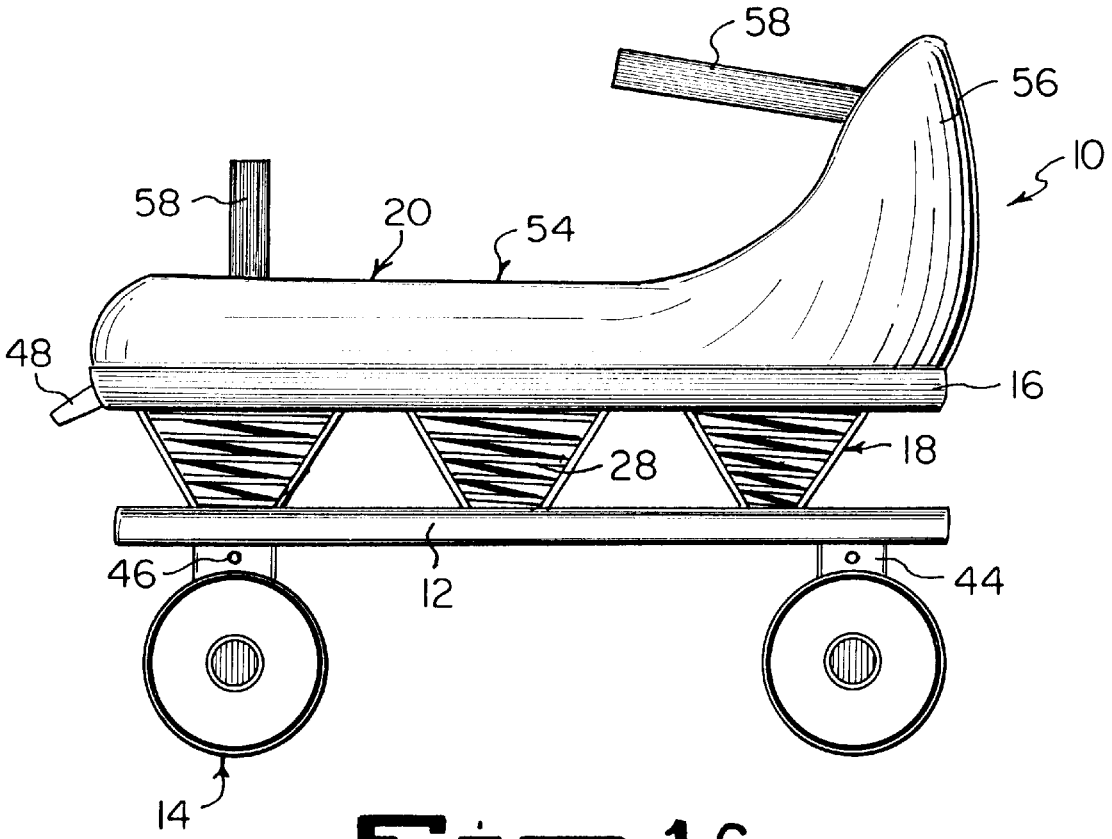
Figure 4:
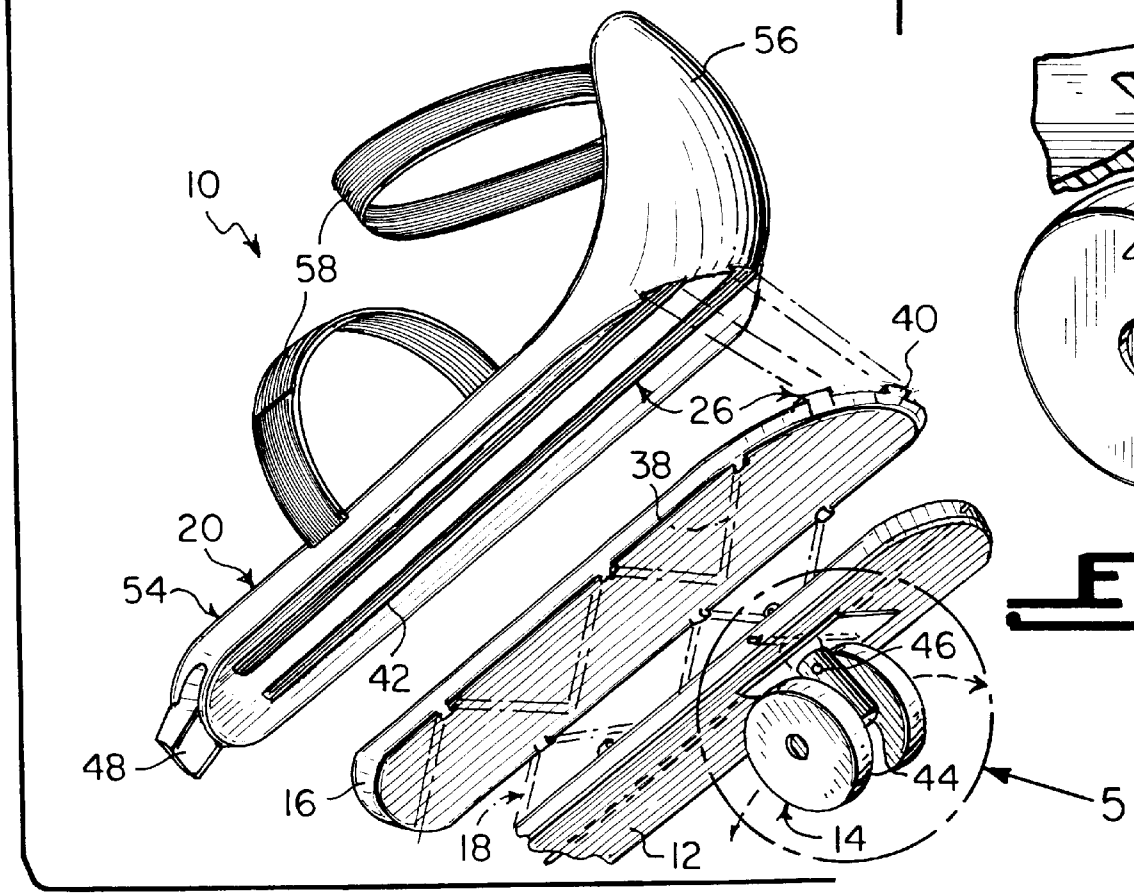
FIG. 4 is an exploded perspective view of the first embodiment with parts broken away and removed therefrom.

The biasing structure 18 can further contain a plurality of cup sockets 36 mounted to the underside of the top plate 16, as shown in FIGS. 1*a* and 1*b*. Each cup socket 36 will engage with a top end of one spring 28, to maintain the spring 28 in position with respect to the base plate 12. The biasing structure 18 can further include as an optional feature, a plurality of rubber bands 38 extending between sides of the base plate 12 and the top plate 16, as shown in FIGS. 1, 2 and 4.

The removable attaching assemblage 26 consists of a tongue 40 and groove 42 configuration between the top plate 16 and the foot plate 20. The tongue 40 and groove 42 configuration extends longitudinally from a rear end to approximate a front end of the top plate 16 and the foot plate 20, so that the foot plate 20 can slide into place onto the top plate 16. Each wheel assembly 14 includes a ball bearing race 44 to rotate three hundred and sixty degrees and a locking button mechanism 46, so that the wheel assembly 14 can be locked in a forward skating position. A brake pad bumper 48 can be mounted on a forward end of the foot plate 20, to allow the skater to stop.

Figure 1D:
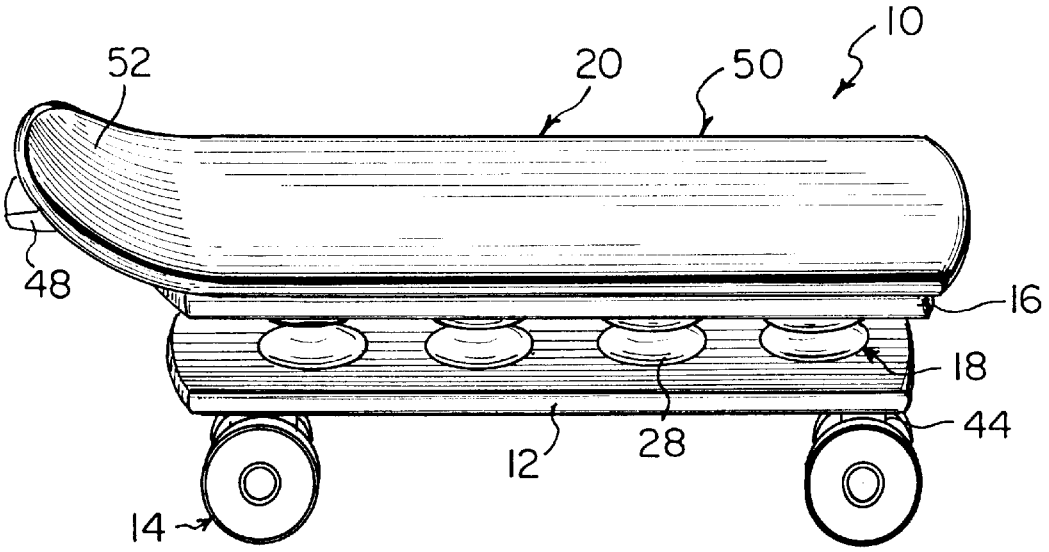
Figures 1E, 1F:
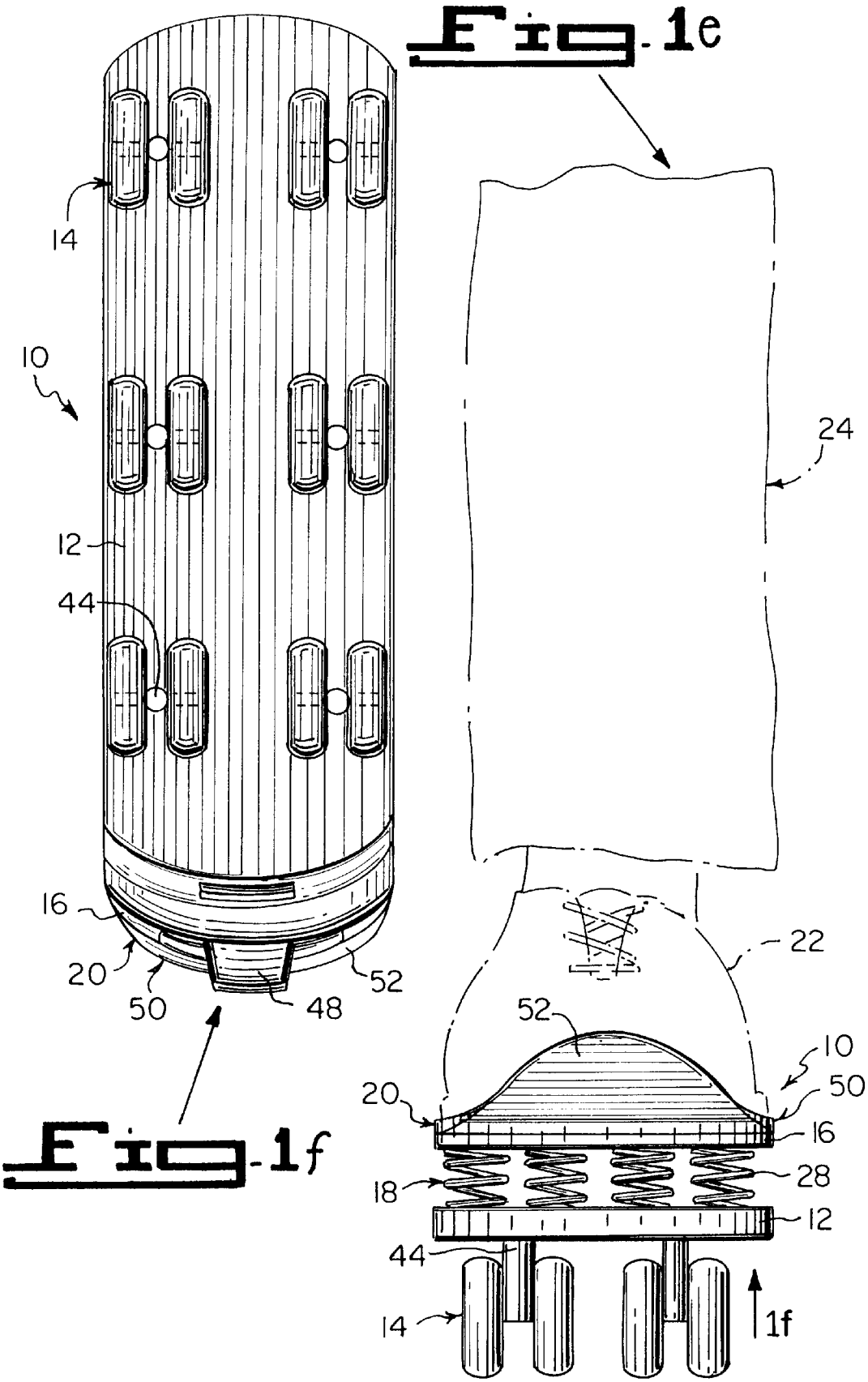
Figure 5:
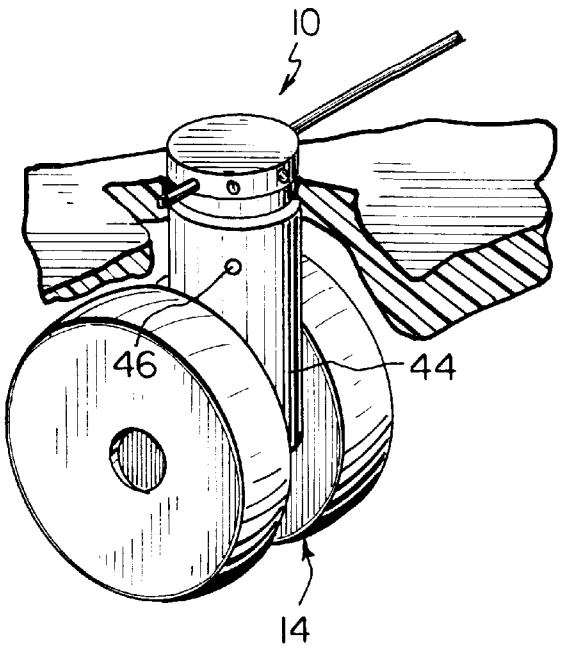
FIG. 5 is an enlarged perspective view of an area in FIG. 4 as indicated by arrow 5, showing one wheel assembly in greater detail.

The foot plate 20, shown in FIGS. 1*d*, 1*e* and 1*f*, is a skateboard deck 50 having a raised tip 52 on a forward end. The foot plate 20, shown in FIGS. 1 to 1*c* and 2 to 4, is a roller skate sole 54 having a raised heel cap 56 to receive the shoe 22 of the skater 24.

Straps 58 are on the roller skate sole 54 to engage with the shoe 22 of the skater 24. A facility 60, shown in FIG. 2, is for retaining the straps 58 to the shoe 22 of the skater 24 in a removable manner. The retaining facility 60 is a fastener 62 selected from the group consisting of VELCRO tabs 64, button snaps 66 and quick release buckles 68.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A roller bouncer and wave board skate comprising:

a) a base plate;

b) a plurality of wheel assemblies disposed on bottom of said base plate;

c) a top plate;

d) means for biasing said top plate over said base plate, said biasing means including:

i) if a plurality of springs spaced apart, retained and extending between said base plate and said top plate; and ii) a plurality of rubber bands extending between sides of said base plate and said top plate;

e) a foot plate to support a shoe of a skater; and f) means for attaching said foot plate to said top plate in a removable manner, so that the skater will bounce while skating.

2. A roller bouncer and wave board skate as recited in claim 1, wherein each said spring is a helical compression spring.

3. A roller bouncer and wave board skate as recited in claim 1, wherein each said spring is an inverted conical compression spring.

4. A roller bouncer and wave board skate as recited in claim 1, wherein said biasing means includes a flat padding member placed between said base plate and said springs.

5. A roller bouncer and wave board skate as recited in claim 4, wherein said flat padding member is fabricated out of a foam rubber material.

6. A roller bouncer and wave board skate as recited in claim 4, wherein said flat padding member is fabricated out of a durable plastic material.

7. A roller bouncer and wave board skate as recited in claim 1, wherein said biasing means further includes a plurality of cup sockets mounted to the underside of said top plate, whereby each said cup socket will engage with a top end of one said spring to maintain said spring in position with respect to said base plate.

8. A roller bouncer and wave board skate as recited in claim 1, wherein said removable attaching means includes a tongue and groove configuration between said top plate and said foot plate, wherein said tongue and groove configuration extends longitudinally from a rear end to approximate a front end of said top plate and said foot plate, so that said foot plate can slide into place onto said top plate.

9. A roller bouncer and wave board skate as recited in claim 1, wherein each said wheel assembly includes a ball bearing race to rotate three hundred and sixty degrees and a locking button mechanism, so that said wheel assembly can be locked in a forward skating position.

10. A roller bouncer and wave board skate as recited in claim 1, further including a brake pad bumper on a forward end Of said foot plate, to allow the skater to stop.

11. A roller bouncer and wave board skate as recited in claim 1, wherein said foot plate is a skateboard deck having a raised tip on a forward end.

12. A roller bouncer and wave board skate as recited in claim 1, wherein said foot plate is a roller skate sole having a raised heel cap to receive the shoe of the skater.

13. A roller bouncer and wave board skate as recited in claim 12, further including:

a) straps on said roller skate sole to engage with the shoe of the skater; and b) means for retaining said straps to said shoe of the skater in a removable manner.

14. A roller bouncer and wave board skate as recited in claim 13, wherein said retaining means is a fastener selected from the group consisting of VELCRO tabs, button snaps and quick release buckles.

15. A roller bouncer and wave board skate as recited in claim 8, wherein each said wheel assembly includes a ball bearing race to rotate three hundred and sixty degrees and a locking button mechanism, so that said wheel assembly can be locked in a forward skating position.

16. A roller bouncer and wave board skate as recited in claim 15, further including a brake pad bumper on a forward end of said foot plate, to allow the skater to stop.

17. A roller bouncer and wave board skate as recited in claim 16, wherein said foot plate is a skateboard deck having a raised tip on a forward end.

18. A roller bouncer and wave board skate as recited in claim 16, wherein said foot plate is a roller skate sole having a raised heel cap to receive the shoe of the skater.

19. A roller bouncer and wave board skate as recited in claim 18, further including:

a) straps on said roller skate sole to engage with the shoe of the skater; and b) means for retaining said straps to said shoe of the skater in a removable manner.

20. A roller bouncer and wave board skate as recited in claim 19, wherein said retaining means is a fastener selected from the group consisting of VELCRO tabs, button snaps and quick release buckles.

* * * * *